US006793529B1

(12) United States Patent
Buenz

(10) Patent No.: US 6,793,529 B1
(45) Date of Patent: Sep. 21, 2004

(54) COAXIAL CONNECTOR WITH POSITIVE STOP CLAMPING NUT ATTACHMENT

(75) Inventor: Larry Buenz, Tinley Park, IL (US)

(73) Assignee: Andrew Corporation, Orland Park, IL (US)

( * ) Notice: Subject to any disclaimer, the term of this patent is extended or adjusted under 35 U.S.C. 154(b) by 0 days.

(21) Appl. No.: 10/605,445

(22) Filed: Sep. 30, 2003

(51) Int. Cl.[7] ..... H01R 9/05; H01R 9/07
(52) U.S. Cl. ..... 439/583; 439/578; 439/584
(58) Field of Search ..... 439/578, 583–586, 439/592, 877–879; 174/88 C; 29/747

(56) References Cited

U.S. PATENT DOCUMENTS

| | | | | |
|---|---|---|---|---|
| 3,199,061 A | | 8/1965 | Johnson et al. | |
| 4,046,451 A | * | 9/1977 | Juds et al. | 439/583 |
| 4,585,289 A | * | 4/1986 | Bocher | 439/312 |
| 5,352,127 A | * | 10/1994 | Muller et al. | 439/188 |
| 5,795,188 A | | 8/1998 | Harwath | 439/583 |
| 5,938,474 A | | 8/1999 | Nelson | 439/583 |
| 6,109,964 A | * | 8/2000 | Kooiman | 439/583 |
| 6,133,532 A | | 10/2000 | Lundback et al. | 174/88 C |
| 6,267,621 B1 | * | 7/2001 | Pitschi et al. | 439/584 |
| 6,386,915 B1 | | 5/2002 | Nelson | 439/584 |
| 6,607,398 B2 | | 8/2003 | Henningsen | 439/578 |

* cited by examiner

*Primary Examiner*—Michael C. Zarroli
(74) *Attorney, Agent, or Firm*—Babcock IP, LLC

(57) ABSTRACT

An electrical connector for coaxial cable, the connector having a positive stop for a clamp nut. The clamp nut driving a means for compression which sandwiches a leading edge of the coaxial cable outer conductor between the connector body and the means for compression. The positive stop positioned to limit tightening of the clamp nut and thereby compression force upon the flared leading edge of the coaxial cable outer conductor to a desired maximum level. The means for compression, for example a circular coil spring may be deformable, allowing the connector to adapt to varying manufacturing tolerances of each connector component, yet still maintaining the maximum desired compression force limit. Thereby, the connector may be correctly installed without requiring use of a torque wrench to ensure proper compression force.

16 Claims, 2 Drawing Sheets

COAXIAL CONNECTOR WITH POSITIVE STOP CLAMPING NUT ATTACHMENT

BACKGROUND OF INVENTION

1. Field of the Invention

This invention relates to electrical cable connectors. More particularly, the invention relates to a coaxial cable connector which clamps the circular outer conductor of the electrical cable; the connector adapted to have a clamp nut with a positive stop at a position corresponding to a desired tightening torque.

2. Description of Related Art

Coaxial cable connectors are used, for example, in communication systems requiring a high level of reliability and precision.

To create a secure mechanical and optimized electrical interconnection between the cable and the connector, it is desirable to have uniform, circumferential contact between a leading edge of the coaxial cable outer conductor and the connector body. A flared end of the outer conductor may be clamped against an annularwedge surface of the connector body, using a clamp nut. Representative of this technology is U.S. Pat. No. 5,795,188 issued Aug. 18, 1998 to Harwath, also owned by applicant, Andrew Corporation and hereby incorporated by reference in the entirety.

To minimize twisting forces upon the outer conductor as the clamp nut is tightened, an opposing thrust collar may be placed between the back side of the flared end of the outer conductor and the clamp nut. To allow the wedge ring to fit over the flared end of the outer conductor an elastic spring, "finger" collar or the like may be used between the thrust collar and the flared end of the outer conductor. Rotation of the clamp nut urges the thrust collar against the spring and the spring against the backside of the flared end of the outer conductor. Thereby, the flared end of the outer conductor is securely sandwiched between the annular wedge surface and the spring.

A connector that is poorly installed may damage equipment, significantly degrade system performance and or lead to premature system failure. Therefore, prior connectors typically include extensive installation instructions that require costly specialized tools.

Threaded connections on and between connectors are typically tightened using wrenches having the potential for large moment arm force generation that may damage the connector and or associated cable(s). Therefore, use of a torque wrench with a torque setting specific to each connector is often specified by the prior connector installation instructions. Applying the proper torque, which may vary depending upon the dimensions of the specific connector and cable materials, for example 20–30 foot-pounds, to threaded connections ensures correct electrical interconnection and prevents application of excessive force that may deform or otherwise damage threads, seals and or the relatively soft metal(s) of the cable(s). The torque wrench is a costly and easily damaged tool that the installation personnel may not always have on hand or bother to use correctly, if at all. Also, connectors may be installed in exposed locations such as the top of radio towers where installation personnel may be less inclined to properly follow time-consuming installation procedures.

Competition in the coaxial cable connector market has focused attention on minimization of overall costs, including training requirements for installation personnel, reduction of dedicated installation tooling and the total number of required installation steps and or operations.

Therefore, it is an object of the invention to provide a connector that overcomes deficiencies in the prior art.

BRIEF DESCRIPTION OF DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

Figure 1:
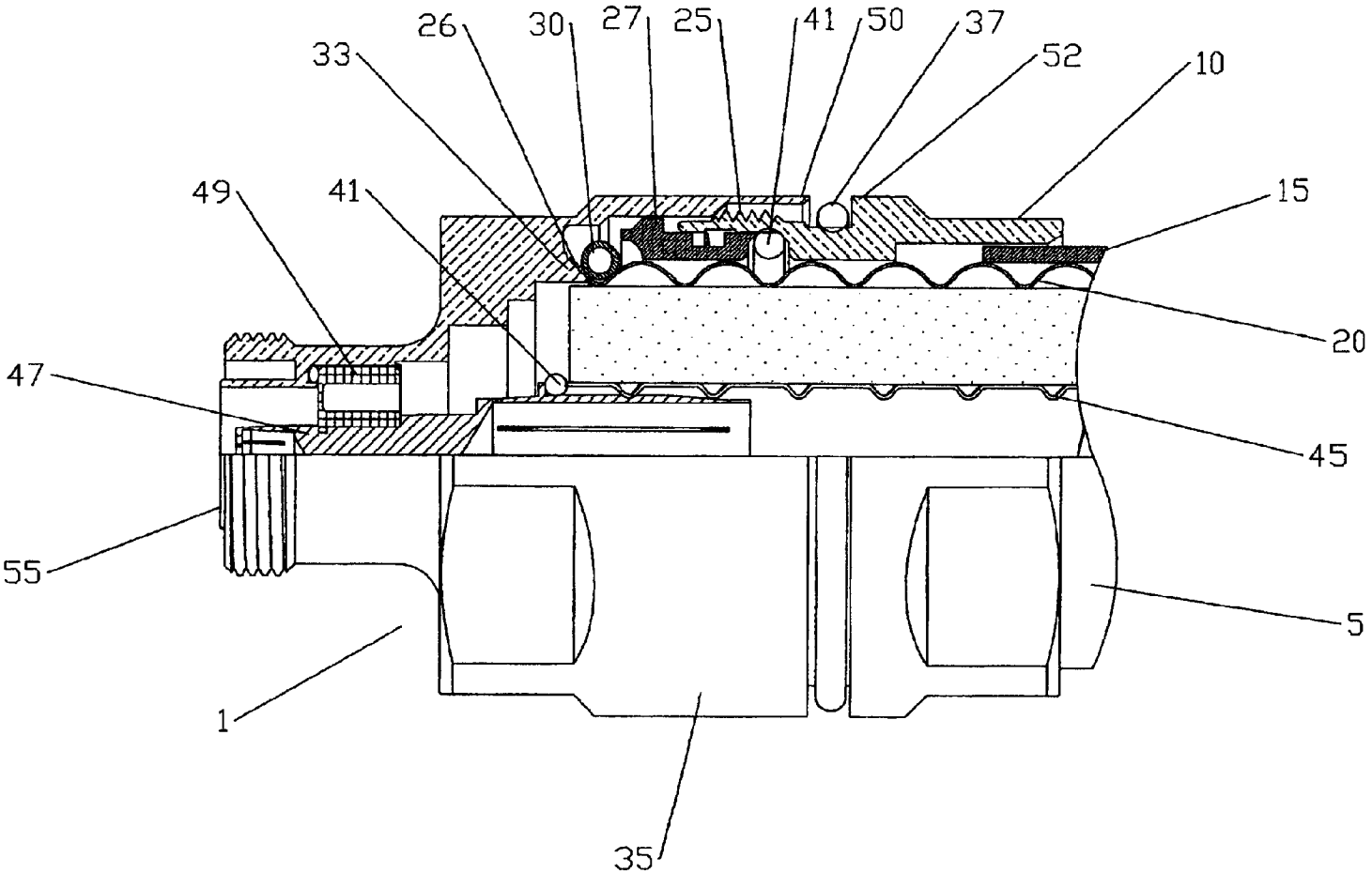
FIG. 1 is a partial cut-away side view of a coaxial connector according to one embodiment of the invention, installed upon a coaxial cable, the clamp nut.
Figure 2:
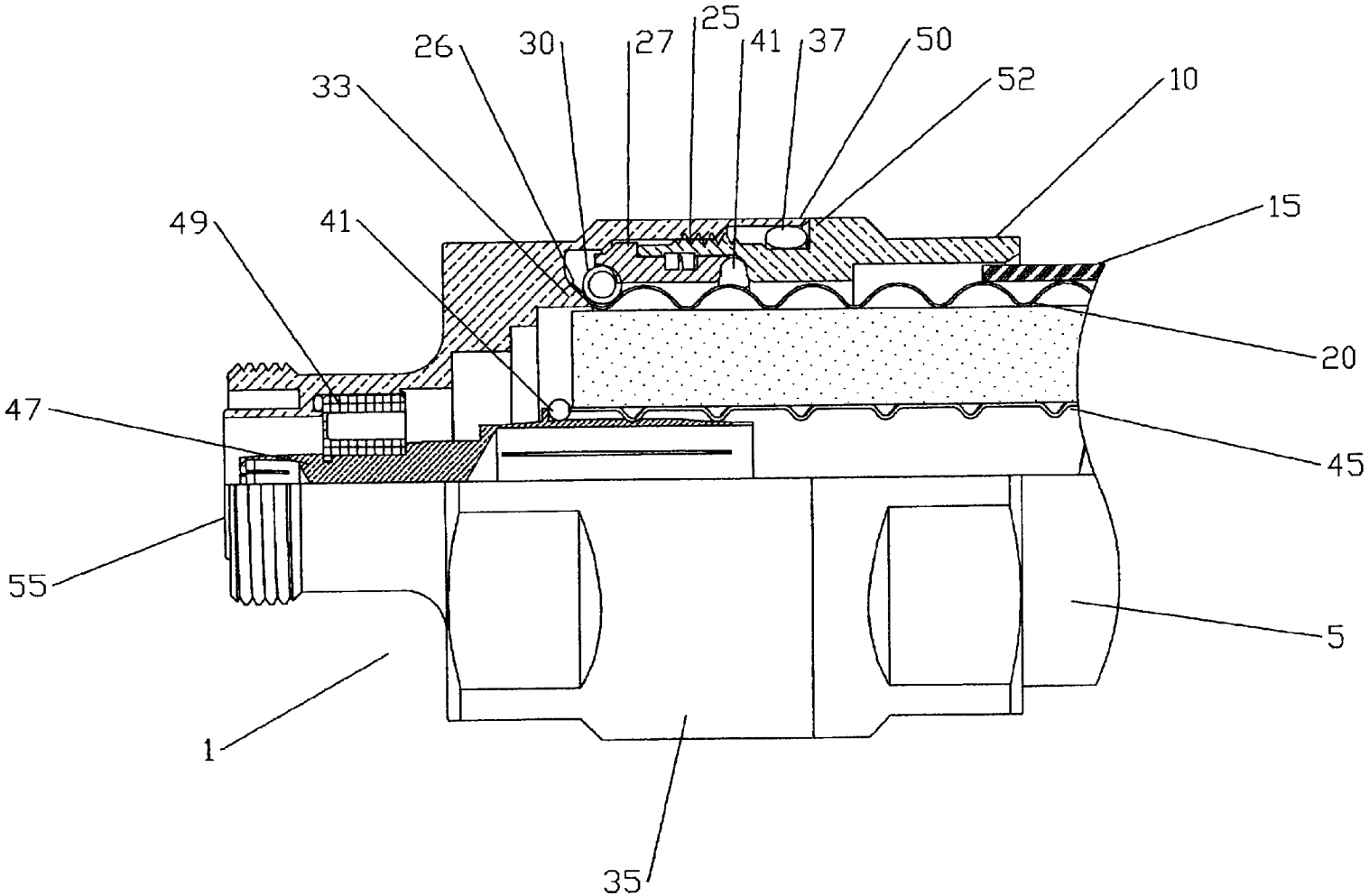
FIG. 2 is a partial cut-away side view of the coaxial connector of FIG. 1, with the clamp nut fully tightened, seated against the positive stop.

As shown in FIGS. 1 and 2, a connector 1 for use with a coaxial cable 5 has a clamp nut 10 adapted to fit over an end portion of the cable 5. A sheath 15 of the cable 5 is removed from the end of the cable 5 to expose the outer conductor 20. Threads 25 between the clamp nut 10 and the connector body 35 operate to drive a thrust collar 27 into a circular coil spring 30 to clamp a flared leading edge 26 of the outer conductor 20 between the circular coil spring 30 and an annular wedge surface 33 of the connector body 35, to secure the connector 1 to the cable 5. The clamping action creates a compression force that is distributed evenly around the annular wedge surface 33 to create a uniform electrical and mechanical interconnection between the connector body 35 and the outer conductor 20.

The connector 1 may be supplied with environmental seals to prevent fouling and or moisture infiltration into the connector 1 and or coaxial cable 5. A stop o-ring 37 seals between the outer-radius of the clamp nut 10 and the connector body 35; an outer-conductor o-ring 39 seals between the clamp nut 10 and the outer conductor 20. Further, an inner conductor o-ring 41 seals between the inner conductor 45 and an inner contact 47 coaxially located within the connector 1 by an insulator 49.

Over tightening of the clamp nut 10 onto the connector body 35 which may generate compression and or shearing forces at damaging levels is prevented by a positive stop configured, for example, between a back end 50 of the connector body 35 and a shoulder 52 of the clamp nut 10. One skilled in the art will recognize that other variations of the positive stop are possible, for example shoulder to shoulder and reversal of the end to stop, etcetera; the limitation being that when reached, the positive stop prevents further threading between the connector body 35 and the clamp nut 10. The relative location upon the connector 1 of the positive stop is adapted to a position where the clamp nut 10 is threaded to the connector body 35 to clamp the flared leading edge 26 of the outer conductor 15 at a desired maximum compression force level. The circular coil spring 30 may be configured to have an acceptable range of deformation prior to collapse to accommodate manufacturing tolerances of the associated connector 1 components and an expected thickness range of the outer conductor 20 flared leading edge 26.

The prior art discloses a range of known equivalents for the circular coil spring 30. For example, U.S. Pat. No.

5,795,188, discloses embodiments replacing the circular coil spring 30 with a clamping ring having a plurality of beads or wedge segments. Further alternatives include a thrust collar or separate ring with a plurality of spring fingers capable of bending to allow initial placement over the flared leading edge 26 but which then either spring down or are forced down by either the clamp nut 10 or connector body 35 to allow the fingers to be compressed against the back side of the flared leading edge 26. One skilled in the art will appreciate that any means for compression that is configured for placement around the back side of the flared leading edge 26 may be applied and then used to retain the flared leading edge 26 against the annular wedge surface 27 of connector body 30 as the clamp nut 10 is tightened.

Preferably, the selected means for compression has a limited deformation characteristic short of a collapse and or crush force level to allow for an increased range of associated component manufacturing tolerances. The limited deformation characteristic may be varied to adapt for observed manufacturing tolerances, for example, by varying the selected material, the configuration of the means for compression and or the thickness of the selected material. The selected limited deformation characteristic may be adapted to provide a desired range of additional compression "slack" before the positive stop is reached, allowing use of overall manufacturing cost saving decreased precision in the manufacturing process but still ensuring that each connector assembly will reach the desired compression force when the positive stop is reached, even if the components of an individual connector each happen to be on the short side of the allowable manufacturing tolerance. In the embodiment of FIG. 1, the means for compression is the circular coil spring 30. The circular coil spring 30 may be adapted to have the desired limited deformation characteristic by selecting an appropriate material such as steel and a desired material thickness wherein the circular coil spring 30 will partially deform over a desired compression force range before either collapsing or transmitting a damaging out of range compression force to the flared leading edge 26 of the outer conductor 20.

In further embodiments, the overlap between the clamp nut 10 and the connector body 35 may be reversed. That is, rather than the connector body overlapping the clamp nut 10 as shown in FIG. 1, the relative positions of the components may be reversed, for example as shown in U.S. Pat. No. 5,795,188. The compression force generation between the components remains the same in either configuration.

In use, the cable 5 end is prepared and the clamp nut 10 placed over the cable end along with any applicable outer conductor o-ring 39 and thrust collar 27. The circular coil spring 31 or other means for compression is then stretched over the flared leading edge 26 into position behind the flared leading edge 26. If used, the stop o-ring 39 is placed upon the clamp nut 10 proximate the shoulder 52. The connector body 35 is then located so that the inner contact 47 engages the inner conductor 45 and the annular wedge surface 33 is pressed against the front side of the flared leading edge 26. The clamp nut 10 is then moved toward the connector body 30 and threaded into the threads 25 as shown in FIG. 1. The clamp nut 10 is threaded until the back end 50 of the connector body 30 reaches the positive stop at the shoulder 52 of the clamp nut 10 as shown in FIG. 2. Reaching the positive stop signifies to the installation personnel that the desired compression force has been reached without requiring use of a torque wrench and prevents further tightening of the clamp nut 10 which would increase the compression force beyond the desired maximum level.

One skilled in the art will appreciate that the connector 1 may be adapted to mate with the dimensions and configuration of a specific coaxial cable 5, for example a coaxial cable 5 with annular or helical corrugations in the inner and or outer conductors 47, 20. To mate with a circular coil spring 30 or the like adapted for use with outer conductor(s) 20 having helical corrugations, the thrust collar 27 may be formed with a step located at a point where the circular coil spring 30 bridges across the corrugations. Further, the connector end 55 of the connector 1 may be adapted to mate according to male and or female embodiments of a proprietary interface or one of the standard connector types, for example BNC, Type-N or DIN.

The present invention provides coaxial connectors with ease of installation features and reduces specialized installation tool requirements. Also, protection from damaging excess torque application during connector installation and elimination of the need for torque wrenches is built into the connector 1.

TABLE OF PARTS

| Table of Parts | |
|---|---|
| 1 | connector |
| 5 | coaxial cable |
| 10 | clamp nut |
| 15 | sheath |
| 20 | outer conductor |
| 25 | threads |
| 26 | flared leading edge |
| 27 | thrust collar |
| 30 | circular coil spring |
| 33 | annular wedge surface |
| 35 | connector body |
| 37 | stop o-ring |
| 39 | outer-conductor o-ring |
| 41 | inner-conductor o-ring |
| 45 | inner conductor |
| 47 | inner contact |
| 49 | insulator |
| 50 | back end |
| 52 | shoulder |
| 55 | connector end |

Where in the foregoing description reference has been made to materials, ratios, integers or components having know equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specifoci details, representative apparatus, methods, and illustrative example shown and described. Accordingly, departures may be made from such details without departure from the spirit or scope of applicat's general inventive concept. Futher, it is to be appreciated that improvements and/or modifications may be made thereto without departing from the scope or spirit of the present invention as defined by the following claims.

What is claimed is:

1. A coaxial connector for use with a coaxial cable having an outer conductor, comprising:

a clamp nut adapted to fit over the outer conductor, the clamp nut having threads that mate with corresponding threads on a connector body;

a circular coil spring adapted to fit over a flared leading edge of the outer conductor;

the connector body having an annular wedge surface adapted to mate with the flared leading edge of the outer conductor;

the threads drawing the clamp nut towards the connector body, driving the circular coil spring to exert a compression force that urges the flared leading edge into contact with the annular wedge surface;

a surface to surface positive stop between the clamp nut and the connector body that stops the compression force at a predetermined maximum torque by preventing further movement of the clamp nut towards the connector body.

2. The connector of claim 1, wherein the positive stop is formed by contact between a back end of the connector body and a shoulder formed in the clamp nut.

3. The connector of claim 1, further including a thrust collar positioned between the clamp nut and the circular coil spring, whereby the clamp nut drives the thrust collar into the circular coil spring.

4. The connector of claim 1, further including a stop o-ring positioned between the connector body and the clamp nut.

5. The connector of claim 1, further including an outer conductor o-ring positioned between the outer conductor and the clamp nut.

6. The connector of claim 1, further including an inner contact positioned coaxially within and electrically isolated from the connector body by an insulator.

7. The connector of claim 1, further including one of a BNC, Type-N and a DIN interface at a connector end of the connector body.

8. A coaxial connector for use with a coaxial cable having an outer conductor, comprising:

a clamp nut adapted to fit over the outer conductor, the clamp nut having threads that mate with corresponding threads on a connector body;

a means for compression adapted to fit over a flared leading edge of the outer conductor;

the connector body having an annular wedge surface adapted to mate with the flared leading edge of the outer conductor;

the threads drawing the clamp nut towards the connector body, driving the means for compression to exert a compression force that urges the flared leading edge into contact with the annular wedge surface;

a surface to surface positive stop between the clamp nut and the connector body that stops the compression force at a predetermined maximum torque by preventing further movement of the clamp nut towards the connector body.

9. The connector of claim 8, wherein the positive stop is formed by contact between a back end of the connector body and a shoulder formed in the clamp nut.

10. The connector of claim 8, further including a thrust collar positioned between the clamp nut and the means for compression, whereby the clamp nut drives the thrust collar into the circular coil spring.

11. The connector of claim 8, wherein the means for compression has a limited deformation characteristic.

12. The connector of claim 8, wherein the means for compression is one a circular coil spring, a ring having a plurality of beads, a ring having a plurality of wedge segments, a ring with a plurality of spring fingers and spring fingers formed in the clamp nut.

13. A coaxial connector for use with a coaxial cable having an outer conductor, comprising:

a clamp nut adapted to fit over the outer conductor, the clamp nut having threads that mate with corresponding threads on a connector body;

a circular coil spring adapted to fit over a flared leading edge of the outer conductor;

the connector body adapted to engage the outer conductor;

the threads drawing the clamp nut towards the connector body, driving the circular coil spring to exert a compression force that urges the outer conductor into contact with the connector body a surface to surface positive stop between the clamp nut and the connector body that stops the compression force at a predetermined maximum torque by preventing further movement of the clamp nut towards the connector body.

14. The connector of claim 13, wherein the positive stop is formed by contact between a back end of the connector body and a shoulder formed in the clamp nut.

15. The connector of claim 13, further including a thrust collar positioned between the clamp nut and the circular coil spring, whereby the clamp nut drives the thrust collar into the circular coil spring.

16. A method for attaching a coaxial connector to a coaxial cable having an outer conductor, comprising the steps of:

placing a clamp nut over a cable end;

stretching a circular coil spring over a flared leading edge of the cable end;

mating a connector body to the cable end;

threading the clamp nut to the connector body until a threading the clamp nut to the connector body until a surface to surface positive stop is reached; the threading urging the clamp nut against the circular coil spring against the flared leading edge against the connector body, creating a maximum predetermined compression force of the flared leading edge onto the connector body.

* * * * *